US006557667B1

(12) United States Patent
Ward

(10) Patent No.: US 6,557,667 B1
(45) Date of Patent: May 6, 2003

(54) CONSTRUCTION MATERIAL HOLDING SYSTEM

(76) Inventor: Roney A. Ward, P.O. Box 1042, Peotone, IL (US) 60468

( * ) Notice: Subject to any disclaimer, the term of this patent is extended or adjusted under 35 U.S.C. 154(b) by 0 days.

(21) Appl. No.: 10/013,011

(22) Filed: Nov. 5, 2001

(51) Int. Cl.[7] ..... E04G 1/15
(52) U.S. Cl. ..... 182/129; 182/132
(58) Field of Search ..... 182/129, 132, 182/113, 117, 222

(56) References Cited

U.S. PATENT DOCUMENTS

| | | | | | |
|---|---|---|---|---|---|
| 979,220 | A | | 12/1910 | Taber | |
| 2,222,078 | A | | 11/1940 | Kroeger et al. | 216/4 |
| 2,285,901 | A | | 6/1942 | Chenoweth | 304/2 |
| 2,820,678 | A | * | 1/1958 | Huber | 182/132 |
| 2,832,479 | A | | 4/1958 | Ottaway | 214/1 |
| 2,872,251 | A | | 2/1959 | Crosby | 304/2 |
| 2,882,100 | A | | 4/1959 | Bank | 304/2 |
| 2,910,135 | A | * | 10/1959 | Moore | 182/113 |
| 3,548,970 | A | | 12/1970 | Hutchens, Sr. | 182/129 |
| 3,717,220 | A | | 2/1973 | Donker et al. | 182/129 |
| 3,785,602 | A | * | 1/1974 | Juculano | 182/113 |
| 4,002,222 | A | * | 1/1977 | Bruno | 182/113 |
| 4,877,069 | A | * | 10/1989 | Plumley | 144/286.1 |
| 5,120,013 | A | | 6/1992 | Sweeney | 248/238 |
| 5,314,167 | A | * | 5/1994 | Holloman | 182/113 |
| 5,638,914 | A | * | 6/1997 | Kizzia | 182/117 |
| 5,746,288 | A | | 5/1998 | O'Neal et al. | 182/118 |
| 5,944,468 | A | | 8/1999 | McBrien | 414/11 |
| 6,009,976 | A | | 1/2000 | Gorney et al. | 182/129 |
| 6,089,749 | A | | 8/2000 | Enochs | 182/129 |

* cited by examiner

*Primary Examiner*—Alvin Chin-Shue

(57) ABSTRACT

A construction material holding system for supporting a plurality of elongate materials upon a walk board without interfering with the usage of the walk board. The construction material holding system includes a plurality of support units each comprised of a support bracket that is removably attachable to a walk board, a vertical support member extending from the support bracket, a first rack attached to an upper portion of the vertical support member, and a second rack attached to an upper end of the first rack. The second rack is preferably removably attached to the first rack for allowing various configurations thereof.

13 Claims, 4 Drawing Sheets

CONSTRUCTION MATERIAL HOLDING SYSTEM

BACKGROUND OF THE INVENTION

1. Field of the Invention

The present invention relates generally to material support devices and more specifically it relates to a construction material holding system for supporting a plurality of elongate materials upon a walk board without interfering with the usage of the walk board.

2. Description of the Prior Art

Walk boards and similar devices have been in use for years. A conventional walk board is typically supported between a pair of ladders or similar elevated structure. The user is then able to walk along the walk board during a construction project such as the application of siding to a building structure.

The main problem with conventional walk board system is that they require the user to repeatedly exit and enter the walk board in order to retrieve fresh construction material. Another problem with conventional walk board systems is that users often times attempt to place a plurality of elongate members, such as siding members, upon the walk board which can be hazardous for working upon the walk board.

Examples of patented devices which are related to the present invention include U.S. Pat. No. 2,222,078 to Kroeger et al; U.S. Pat. No. 6,089,749 to Enochs; U.S. Pat. No. 2,910,135 to Moore; U.S. Pat. No. 5,120,013 to Sweeney; U.S. Pat. No. 5,944,648 to McBrien; U.S. Pat. No. 5,746,288 to O'Neal et al; U.S. Pat. No. 6,009,976 to Gorney et al; U.S. Pat. No. 3,717,220 to Donker et al; U.S. Pat. No. 2,872,251 to Crosby; U.S. Pat. No. 979,220 to Taber; U.S. Pat. No. 2,882,100 to Bank; U.S. Pat. No. 2,832,479 to Ottaway; U.S. Pat. No. 3,548,970 to Hutchens Sr; and U.S. Pat. No. 2,285,901 to Chenoweth.

While these devices may be suitable for the particular purpose to which they address, they are not as suitable for supporting a plurality of elongate materials upon a walk board without interfering with the usage of the walk board. Conventional walk board systems are not suitable for supporting a plurality of elongate members relating to a construction project thereby requiring the use of the walk board to repeatedly exit and enter the walk board.

In these respects, the construction material holding system according to the present invention substantially departs from the conventional concepts and designs of the prior art, and in so doing provides an apparatus primarily developed for the purpose of supporting a plurality of elongate materials upon a walk board without interfering with the usage of the walk board.

SUMMARY OF THE INVENTION

In view of the foregoing disadvantages inherent in the known types of walk board systems now present in the prior art, the present invention provides a new construction material holding system construction wherein the same can be utilized for supporting a plurality of elongate materials upon a walk board without intefering with the usage of the walk board.

The general purpose of the present invention, which will be described subsequently in greater detail, is to provide a new construction material holding system that has many of the advantages of the walk board systems mentioned heretofore and many novel features that result in a new construction material holding system which is not anticipated, rendered obvious, suggested, or even implied by any of the prior art walk board systems, either alone or in any combination thereof.

To attain this, the present invention generally comprises a plurality of support units each comprised of a support bracket that is removably attachable to a walk board, a vertical support member extending from the support bracket, a first rack attached to an upper portion of the vertical support member, and a second rack attached to an upper end of the first rack. The second rack is preferably removably attached to the first rack for allowing various configurations thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a construction material holding system that will overcome the shortcomings of the prior art devices.

A second object is to provide a construction material holding system for supporting a plurality of elongate materials upon a walk board without interfering with the usage of the walk board.

Another object is to provide a construction material holding system that reduces the number of times a user must exit and enter the walk board during a construction project.

An additional object is to provide a construction material holding system that reduces the amount of time required to finish a construction project.

A further object is to provide a construction material holding system that increases the safety of workers working upon a walk board.

Another object is to provide a construction material holding system that eliminates the need to plate elongate members upon the walk board.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
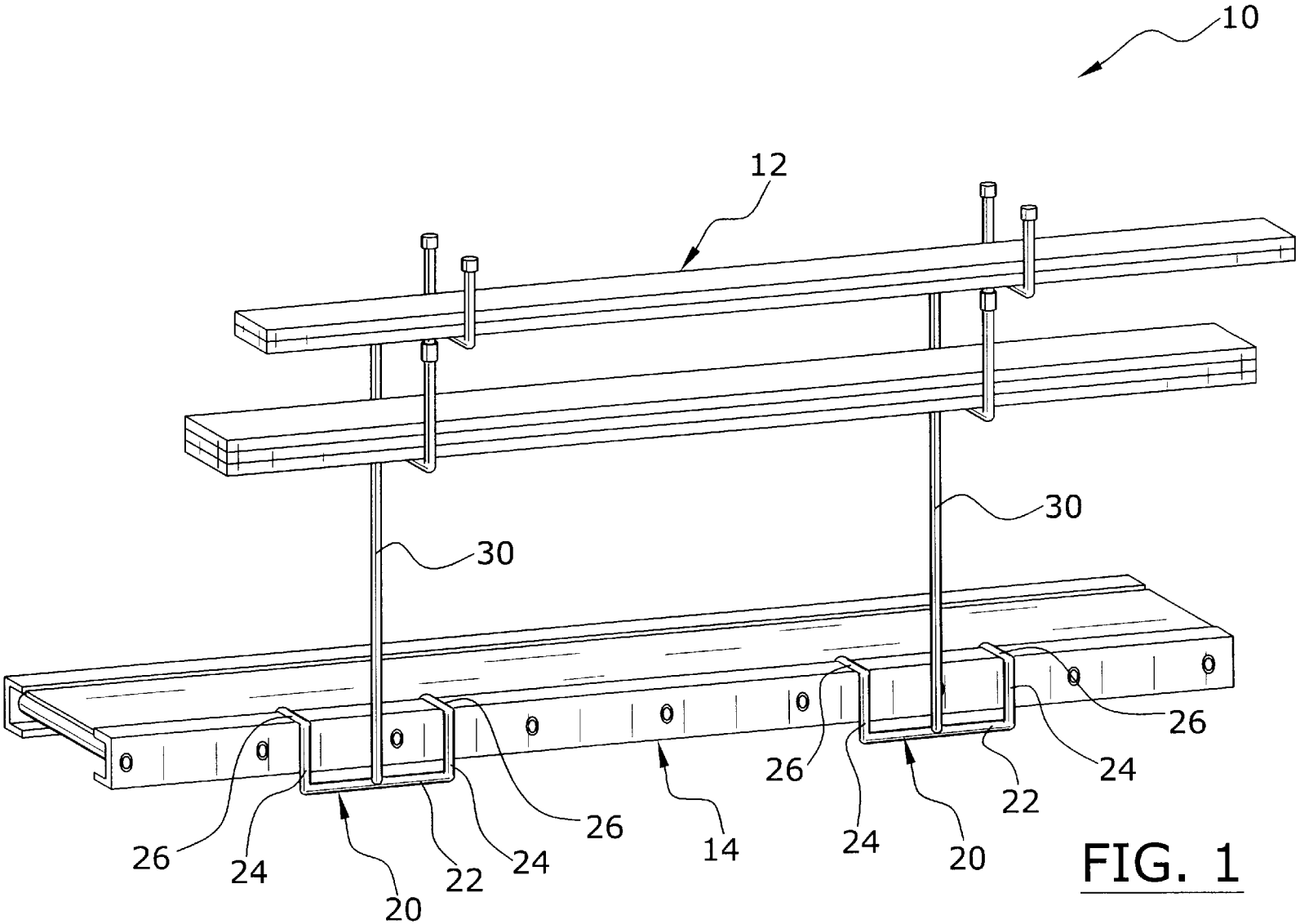
FIG. 1 is an upper perspective view of the present invention removably attached to an edge of a walk board supporting a plurality of elongate members.

Turning now descriptively to the drawings, in which similar reference characters denote similar elements throughout the several views, FIGS. 1 through 4 illustrate a construction material holding system 10, wherein each comprises a plurality of supports units each comprised of a support bracket 20 that is removably attachable to a walk board 14, a vertical support member 30 extending from the support bracket 20, a first rack 40 attached to an upper portion of the vertical support member 30, and a second rack 50 attached to an upper end of he first rack 40. The second rack 50 is preferably removably attached to the first rack 40 for allowing various configurations thereof.

Figure 3:
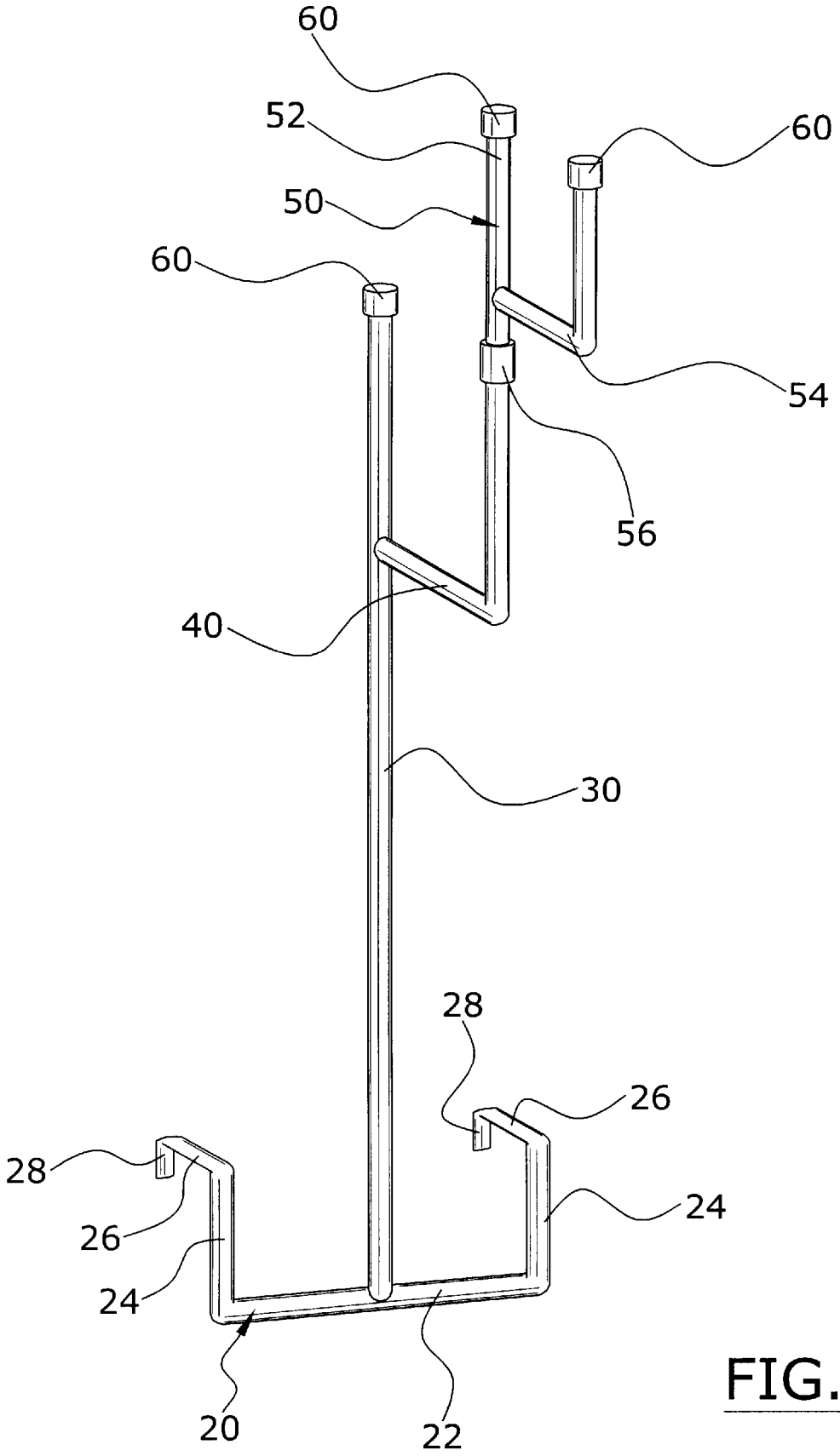
FIG. 3 is an upper perspective view of the present invention as a single unit.
Figure 4:
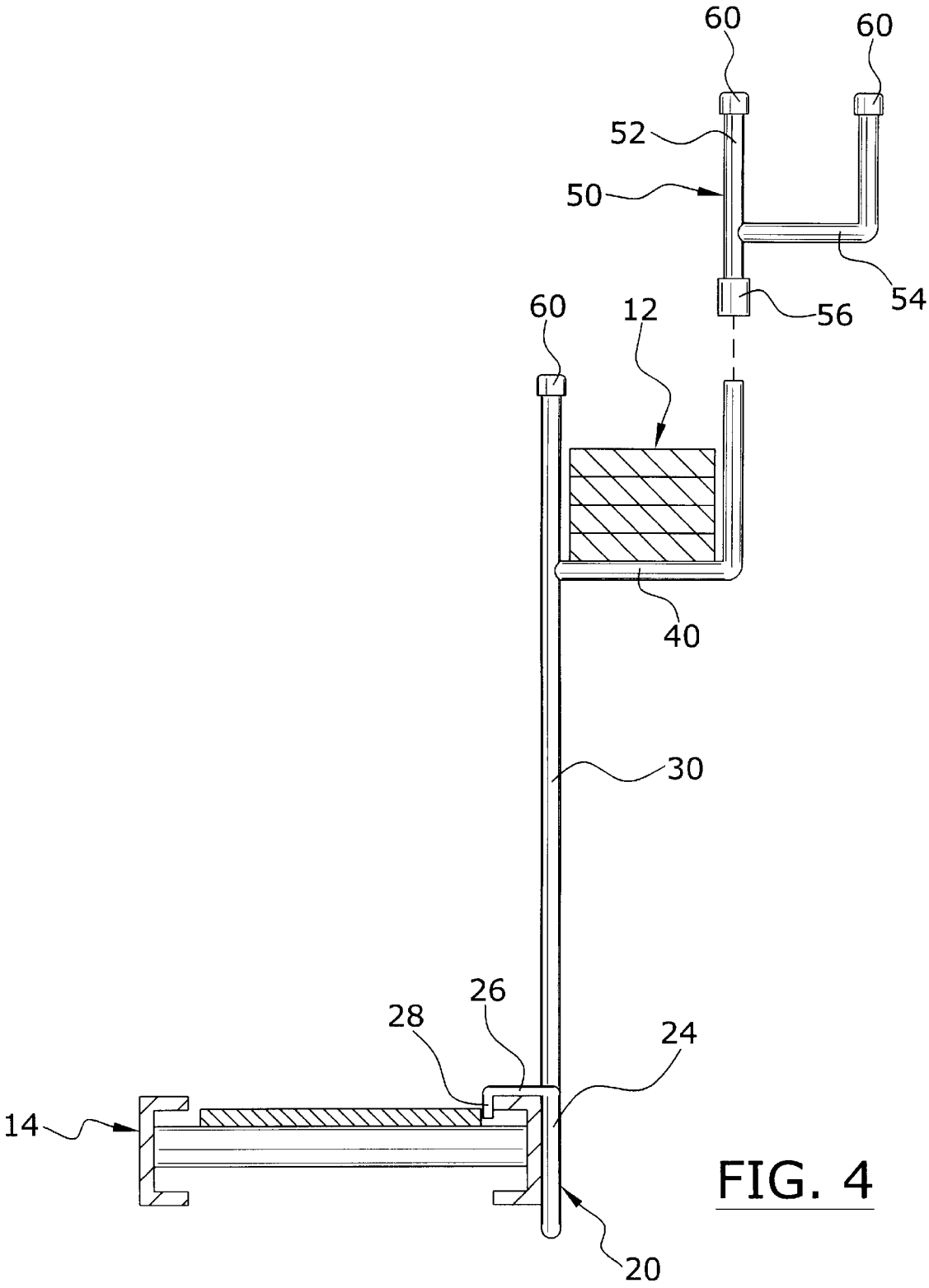
FIG. 4 is a cross-sectional view taken along line 4—4 with the upper rack removed from the main rack.

As shown in FIGS. 3 and 4 of the drawings, the support bracket 20 is comprised of a horizontal member attached to a lower end of the vertical support member 30. As shown in FIG. 3 of the drawings, a plurality of vertical members 24 extend upwardly from the lower member 22. The vertical members 24 preferably extend upwardly from the distal ends of the lower member 22 for providing increased stability to the unit.

As further shown in FIG. 3 of the drawings, a corresponding plurality of horizontal members 26 extend horizontally from the vertical members 24. As shown in FIG. 4 of the drawings, the horizontal members 26 extend a sufficient distance from the vertical members 24 so as to extend past a side support member of the walk board 14.

As shown in FIGS. 3 and 4 of the drawings, a plurality of lip members 28 extend downwardly from the distal ends of the horizontal members 26 to catchably engage the side support member of the walk board 14. As shown in FIG. 4 of the drawings, the horizontal members 26 and the lip members 28 are preferably comprised of a relatively flat structure.

As best shown in FIG. 3 of the drawings, the vertical support member 30 extends upwardly from the support bracket 20. The lower end of the vertical support member 30 is preferably attached to a central portion of the lower member 22 of the support bracket 20 as best shown in FIG. 3 of the drawings. The vertical support member 30 extends upwardly a desired distance that provides a sufficient elevation for the first rack 40 to comfortably support a plurality of elongate members 12. More than one vertical support member 30 may be utilized with the present invention as can be appreciated. The vertical support member 30 is preferably comprised of a straight structure, however various other shapes may be utilized to construct the vertical support member 30.

As shown in FIGS. 1 through 4 of the drawings, a first rack 40 is attached to an upper portion of the vertical support member 30. The first rack 40 is preferably secured a finite distance below an upper end of the vertical support member 30 as best shown in FIG. 4 of the drawings. The first rack 40 is comprised of an L-shaped structure rotated by ninety degrees that forms a U-shaped structure with the vertical support member 30. It can be appreciated that more than one rack may be attached to the vertical support member 30.

As shown in FIGS. 1 and 4 of the drawings, a second rack 50 is preferably removably attached to an upper end of the first rack 40. The second rack 50 preferably is comprised of a vertical rack member 52, a coupler 56 attached to the lower end of the vertical rack member 52, and an extended member 54 extending from the vertical rack member 52. The coupler 56 is comprised of a tubular structure that has a sufficient inner opening that is sufficient to snugly fit about the upper end of the first rack 40 as shown in FIG. 4 of the drawings. The coupler 56 may also be formed to have an outer diameter that fits within an upper opening within the first rack 40. The extended member 54 is comprised of an L-shaped member rotated ninety degrees to form a U-shaped structure with the vertical rack member 52. It can be appreciated that additional racks may be removably attached to the upper edge of the second rack 50 to create various configurations of the present invention.

As shown in FIGS. 1 through 4 of the drawings, a plurality of cap members 60 are attached to the distal upper ends of the vertical support member 30, and the second rack 50. The plurality of cap members 60 are preferably comprised of a resilient material such as but not limited to rubber or plastic.

Figure 2:
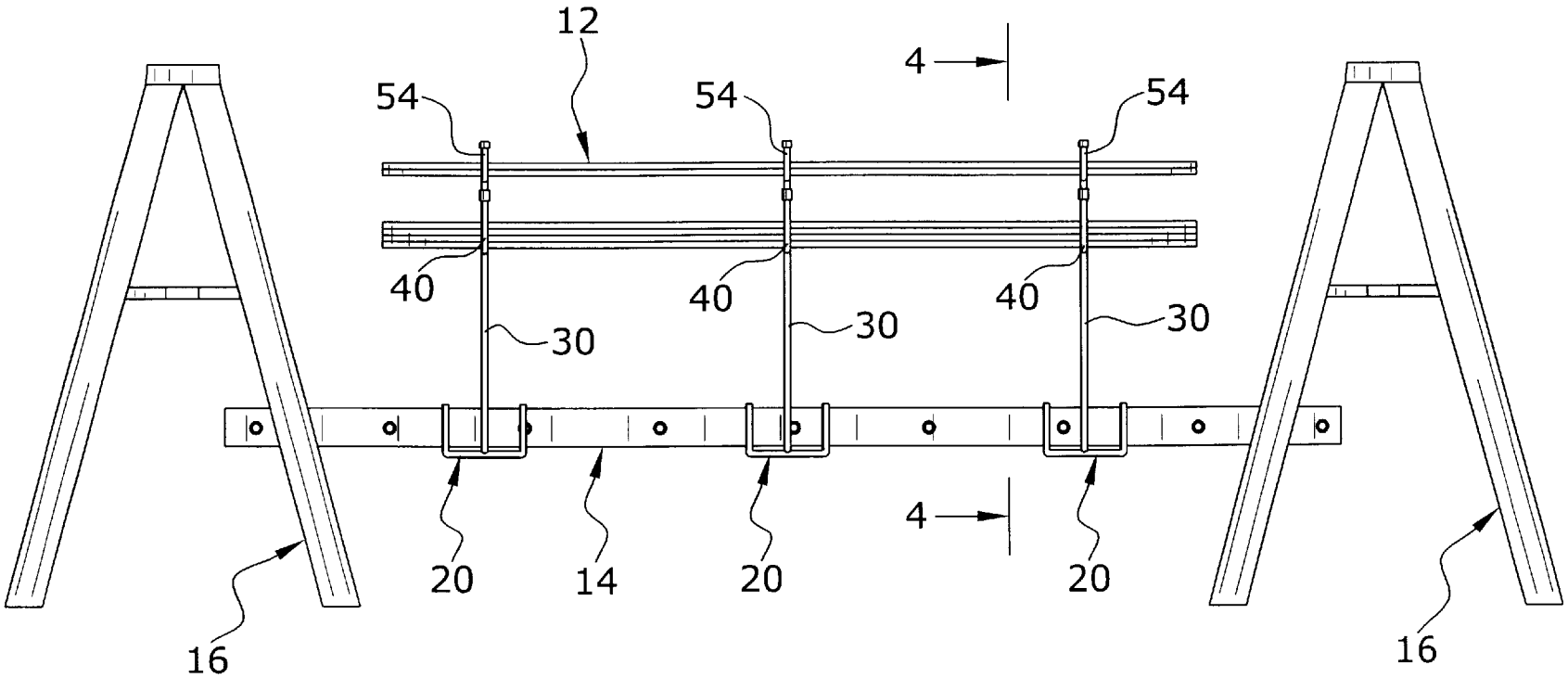
FIG. 2 is a front view of the present invention removably attached to an edge of a walk board supporting a plurality of elongate members.

In use, the user positions a plurality of support units along a walk board 14 depending upon the length and type of elongate members 12 to be supported. If additional storage of the elongate member is desired, the second rack 50 is attached to each first rack 40 as shown in FIGS. 1 through 3 of the drawings. To attach the plurality of support units, the user inserts the lip members 28 into a slot between a middle support pad and a side support member of the walk board 14 as best shown in FIG. 4 of the drawings. The user then lowers the support unit until the horizontal members 26 are adjacent the upper surface of the side support member and the lower portion of the vertical support member 30 is adjacent the outside portion of the side support member of the walk board 14. The user then positions the desired amount of elongate members 12 upon the first rack 40 and the second rack 50 as shown in FIGS. 1, 2 and 4 of the drawings. The user then stands upon the walk board 14 and then is able to easily retrieve the elongate members 12 without having to leave the elevated walk board 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A construction material holding system comprised of a plurality of support units removably attachable to a walk board for supporting a plurality of elongate members, each support unit comprising:

support bracket removably attachable to side support member of said walk board, wherein said support bracket is comprised of:

a lower member attached traversely to said lower end of said vertical support member;

a plurality of vertical members extending upwardly from said lower member;

a plurality of horizontal members extending horizontally from a distal end of each of said plurality of vertical members; and a plurality of lip members extending downwardly from a distal end of said plurality of horizontal members for catchably engaging and side support member of said walk board;

a vertical support member having a lower end and an upper end, wherein said lower end is attached to said support bracket and extends upwardly in a vertical manner from said support bracket;

a first rack permanently attached to an upper portion of said vertical support member, wherein said first rack extends away from said vertical support member in a manner opposite of said support bracket, wherein said first rack forms a U-shaped structure with said vertical support member for receiving said elongate members; and a second rack removably attachable to an upper end of said first rack, wherein said second rack is comprised of:

a vertical;

an extended member extending horizontally from said vertical member, wherein a distal portion of said extended member is bent upwardly thereby forming a U-shaped structure with said vertical member; and a coupler attached to a lower end of said vertical member for removably attaching to an upper end of said/first rack, wherein said coupler is comprised of a tubular structure formed for snugly fitting about said first rack.

2. The construction material holding system of claim 1, wherein said vertical support member is comprised of a straight vertical structure.

3. The construction material holding system of claim 1, wherein said plurality of lip members are comprised of a flat structure.

4. The construction material holding system of claim 1, wherein said plurality of horizontal members are comprised of a flat surface.

5. The construction material holding system of claim 1, wherein said horizontal members are orthogonal with respect to said lip members.

6. The construction material holding system of claim 1, including a plurality of cap members attached to distal ends of said vertical support member and said first rack.

7. A construction material holding system comprised of a plurality of support units removably attachable to a walk board for supporting a plurality of elongate members, each support unit comprising:

a support bracket removably attachable to a side support member of said walk board, wherein said support bracket is comprised of:

a lower member attached traversely to said lower end of said vertical support member;

a plurality of vertical members extending upwardly from said lower member;

a plurality of horizontal members extending horizontally from a distal end of each of said plurality of vertical members; and a plurality of lip members extending downwardly from a distal end of said plurality of horizontal members for catchably engaging said side support member of said walk board;

a vertical support member having a lower end and an upper end, wherein said lower end is attached to said support bracket and extends upwardly in a vertical manner from said support bracket;

a first rack permanently attached to an upper portion of said vertical support member, wherein said first rack extends away from said vertical support member in a manner opposite of said support bracket, wherein said first rack forms a U-shaped structure with said vertical support member for receiving said elongate members; and a second rack permanently attached to an upper end of said first rack, wherein said second rack is comprised of:

a vertical member; and an extended member extending horizontally from said vertical member, wherein a distal portion of said extended member is bent upwardly thereby forming a U-shaped structure with said vertical member.

8. The construction material holding system of claim 2, wherein said vertical support member is comprised of a straight vertical structure.

9. The construction material holding system of claim 7, wherein said plurality of lip members are comprised of a flat structure.

10. The construction material holding system of claim 7, wherein said plurality of horizontal members are comprised of a flat structure.

11. The construction material holding system of claim 7, wherein said horizontal members are orthogonal with respect to said lip members.

12. The construction material holding system of claim 7, including a plurality of cap members attached to distal ends of said vertical support member and said first rack.

13. A construction material holding system comprised of a plurality of support units removably attachable to a walk board for supporting a plurality of elongate members, each support unit comprising:

a support bracket removably attachable to a side support member of said walk board, wherein said support bracket is comprised of:

a lower member attached traversely to said lower end of said vertical support member;

a plurality of vertical members extending upwardly from said lower member;

a plurality of horizontal members extending horizontally from a distal end of each of said plurality of vertical members; and a plurality of lip members extended downwardly from a distal end of said plurality of horizontal members for catchably engaging said side support member of said walk board;

a vertical support member having a lower end and an upper end, wherein said lower end is attached to said support bracket and extends upwardly in a vertical manner from said support bracket;

a first rack permanently attached to an upper portion of said vertical support member, wherein said first rack extends away from said vertical support member in a manner opposite of said support bracket, wherein said first rack forms a U-shaped structure with said vertical support member for receiving said elongate members;

a plurality of cap members attached to distal ends of said vertical support member and said first rack; and a second rack attachable to an upper end of said first rack, wherein said second rack is comprised of:

a vertical member;

an extended member extending horizontally from said vertical member, wherein a distal portion of said extended member is bent upwardly thereby forming a U-shaped structure with said vertical member; and a coupler attached to a lower end of said vertical member for removably attaching to an upper end of said first rack, wherein said coupler is comprised of a tubular structure formed for snugly fitting about said first rack;

wherein said vertical support member is comprised of a straight vertical structure;

wherein said plurality of lip members are comprised of a flat structure;

wherein said plurality of horizontal members are comprised of a flat structure;

wherein said horizontal members are orthogonal with respect to said lip members.

* * * * *